United States Patent [19]

Bounds

[11] 4,193,521

[45] Mar. 18, 1980

[54] DUAL CONDIMENT DISPENSER

[76] Inventor: William E. Bounds, 23790 Hawthorne Blvd., Torrance, Calif. 90505

[21] Appl. No.: 912,733

[22] Filed: Jun. 5, 1978

[51] Int. Cl.[2] ..... A47G 19/24

[52] U.S. Cl. ..... 222/142.4; D7/57

[58] Field of Search ..... 222/142.4, 142.1–142.3, 222/142.5–142.9; D7/57

[56] References Cited

U.S. PATENT DOCUMENTS

| | | | |
|---|---|---|---|
| 1,765,152 | 6/1930 | Hart et al. | 222/142.4 |
| 1,954,719 | 4/1934 | Vendel | 222/142.4 |
| 2,184,302 | 12/1939 | Hull et al. | 222/142.4 |
| 2,216,345 | 10/1940 | Haskin et al. | 222/142.4 |
| 2,482,327 | 9/1949 | Dawson et al. | 222/142.4 |
| 2,679,952 | 6/1954 | Carpenter | 222/142.4 |

*Primary Examiner*—F. J. Bartuska
*Attorney, Agent, or Firm*—Edward A. Sokolski

[57] ABSTRACT

A condiment dispenser having two separate compartments for use in separately dispensing two different condiments, such as salt and pepper. A container is divided into two separate compartments by means of a partition which runs vertically between the bottom and the top thereof. The top of the compartment is covered by a cap member which is removably attached thereto by suitable means such as an interference fit. One or more apertures are formed in opposite portions of the sides of the cap member to form a condiment pouring outlet for each of the compartments. A baffle member is formed in the cap member opposite each of the outlets, each of said baffle members partially surrounding its associated outlet and having triangularly cross-sectioned deflector portions. The apices of the deflector portions are positioned directly opposite the apertures such that when the condiment is being shaken out of one of the compartments, the baffle will tend to prevent the condiment in the other of the compartments from being shaken out of its outlet.

6 Claims, 5 Drawing Figures

DUAL CONDIMENT DISPENSER

This invention relates to condiment dispensers, and more particularly to such a dispenser having dual compartments for use in separately dispensing two different condiments.

Condiment dispensers have been developed in the prior art for dispensing two different condiments such as salt and pepper. Many of these, as exemplified in my U.S. Pat. No. 3,168,256, involve a combination pepper mill and salt dispenser positioned one above the other. The present invention is involved with a simple dispenser for two condiments which does not employ a grinder but rather involves a single container unit which has a vertical partition which divides the container into a pair of separate compartments, one for each of the condiments.

In experimenting with this type of device, it was found that when dispensing one of the condiments with the usual shaking action, the other condiment tended to be inadvertently shaken out of its outlet, with the resultant undesirable effects particularly in the case of pepper. The device of th present invention overcomes these shortcomings by a simple yet highly effective baffle member placed in the cap of the dispenser opposite each of the condiment outlets, these baffle members operating to effectively prevent the condiment not being purposely dispensed from passing through its outlet, at the same time is no way interfering with the normal dispensing of the condiments.

It is therefore an object of this invention to provide an improved dual condiment dispenser for separately dispensing two different condiments, such as salt and pepper.

It is a further object of this invention to provide a dual condiment dispenser having means for preventingj the second condiment from being inadvertently ejected from its compartment while the first condiment is being purposely dispensed.

Other objects of this invention will become apparent as the description proceeds in connection with the accomanying drawings, of which:

Figure 1:
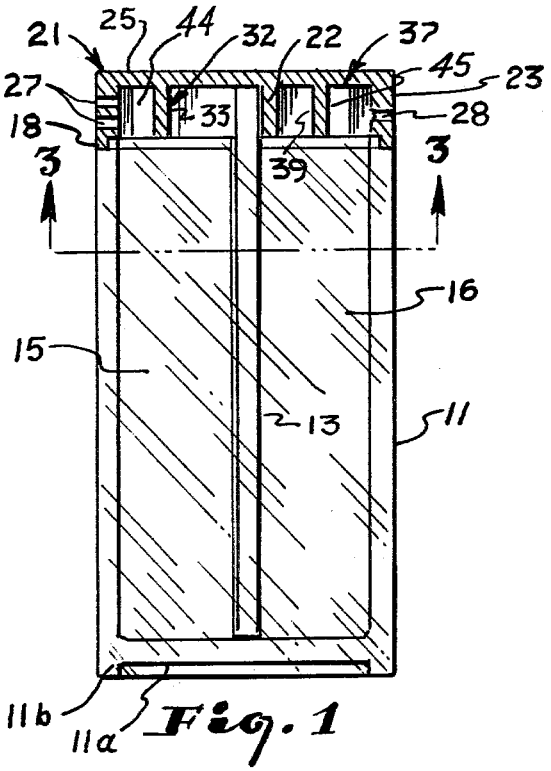
FIG. 1 is a side elevational view in cross-section of a preferred embodiment of the invention.
Figure 2:
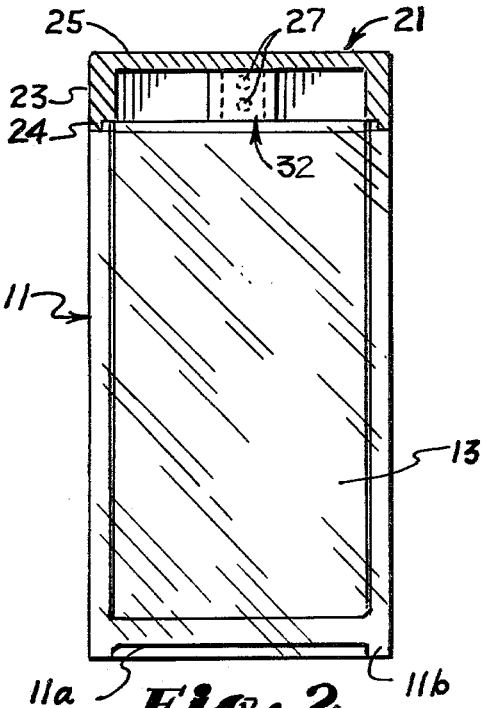
FIG. 2 is a side elevational view in cross-section of the preferred embodiment taken 90° from the view of FIG. 1.
Figure 3:
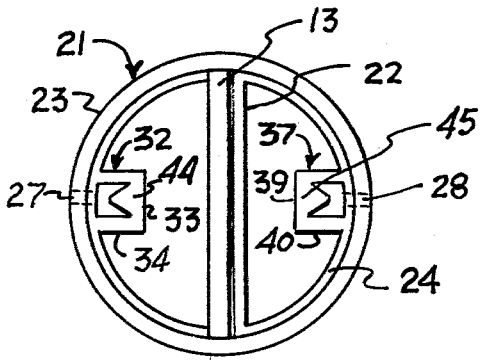
FIG. 3 is a cross-sectional view taken along the plane indicated by 3—3 in FIG. 1.
Figure 5:
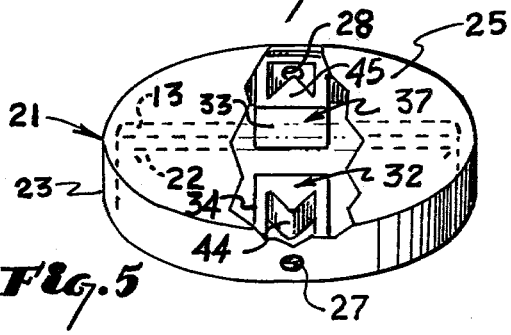
FIG. 5 is a perspective view illustrating the cap member and the baffle members of the preferred embodiment.

Briefly described, my invention is as follows:

A container, which in the illustrative embodiment is cylindrical but may also be rectangular or square, has a partition or divider which extends longitudinally from the top to the bottom thereof and divides the container into two substantially equal compartments. The top of the container is covered by a cap member which has a side wall which extends upwardly from the side wall of the container and is substantially flush therewith. Extending between the top edges of the side wall of the cap member is a flat top wall. The side wall of the cap portion has an undercut bottom edge forming a shoulder and lip portion which engages a mating undercut edge along the top of the container in a tight fitting relationship such that the cap member can be removed by lifting it with one's finger when necessary to fill the container with condiments. The cap member has one or more apertures in the side walls thereof for each of the compartments of the container, these apertures being used for dispensing the condiments. Formed in the cap member opposite each aperture or group of apertures is a baffle member, these baffle members being in the form of small blocks which extend inwardly from the inner surface of the side wall of the cap member. The baffle units have a deflector with a triangular cross-section which have their apices directly opposite the dispensing apertures such that when condiment is being shaken from one of the compartments, the condiment in the other compartment is deflected away from its dispensing aperture or apparatus, thus avoiding inadvertent dispensing of the other condiment.

Referring now to FIGS. 1–3 and 5, a preferred embodiment of the invention is illustrated. Container 11 in the illustrative embodiment is cylindrical in form and made of clear plastic. The container may also be square, rectangular or other shapes and could be made of material other than clear plastic. The bottom of the container has a recessed central portion 11*a*, the edge portion 11*b* of the bottom forming a support rim. Running longitudinally down the center of the container from the bottom wall to the top thereof is a divider wall or partition member 13 which divides the container into two separate compartments 15 and 16. Divider 13 extends above the top edge of the container where it abuts against a rib portion 22 of cap 21 as well as the inner surface of the top wall 25 of the cap. The top edge 18 of the container is undercut so as to form a circular shoulder into which a mating undercut portion 24 fits in a removable but tightly engaging relationship.

The cap member 21 has a cylindrical side wall 23 which extends axially from the side wall of the container, and a flat disc shaped top wall 25. Formed in wall 23 on one side thereof are a pair of vertically aligned apertures 27 which communicate with compartment 15 and through which the condiment contained within compartment 15 is dispensed. Formed in an opposite portion of wall 23 is a single aperture 28 which provides a dispensing aperture for the condiment in compartment 16.

Opposite apertures 27 is a block shaped baffle member 32 which has a rear wall 33, and side walls 34 forming a chamber 36 which is open at its bottom and thus in communication with compartment 15. A similar baffle member 37 is formed opposite aperture 28, this baffle member having an end wall 39 and side walls 40 forming a chamber 41 which is in fluid communication with compartment 16. Extending from end walls 33 and 39 are similar deflector members 44 and 45 having triangular cross-sections, the apices of these triangles being positioned apertures 27 and aperture 28 respectively.

Figure 4:
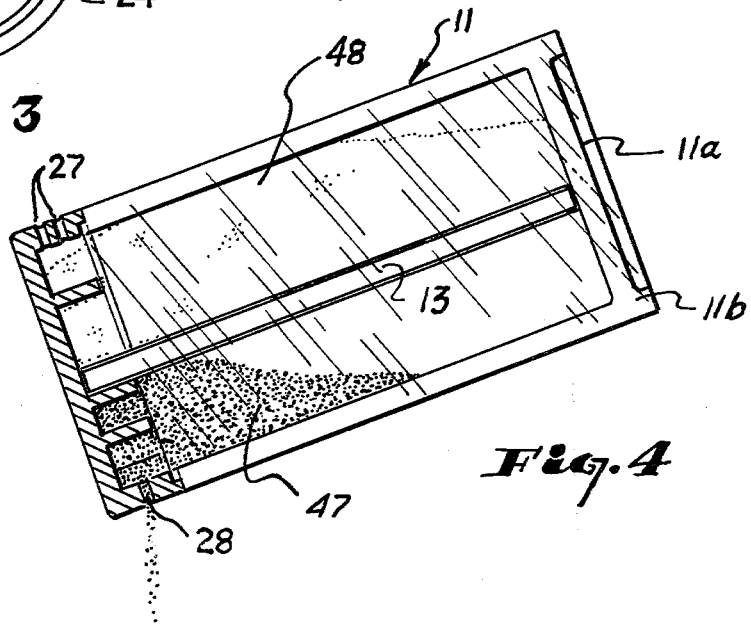
FIG. 4 is a side view in cross-section showing the preferred embodiment in use.

The operation of the device is illustrated in FIG. 4. As can be seen, when the condiment 47 within compartment 16 is being dispensed with a shaking motion, some of the condiment 48 within compartment 15 may enter the chamber 36 of baffle member 32. However, this condiment will tend to fall along the sloped walls of deflector 44 such that with the shaking motion it will not tend to be shaken out through apertures 27, but rather be deflected against the adjacent wall portions of the chamber. Inadvertent dispensing of the condiment in compartment 15 will thus be minimized.

While the invention has been described and illustrated in detail, it is to be clearly understood that this is to be taken by way of illustration and example only and not by way of limitation, the spirit and scope of the invention being limited only by terms of the following claims.

I claim:

1. A condiment dispenser for separately dispensing two different condiments, comprising:

a container member having side and bottom wall portions, a divider wall extending longitudinally from the bottom to the top of the container, dividing the container into first and second compartments, and a cap member removably fitted over the top of said container, said cap member having a side wall portion which extends axially from the top edge of the container and a top wall portion extending between the top edges of the side wall portion, said side wall portion having first and second aperture means formed therein located above the first and second compartments respectively, and a first and second block-shaped baffle member formed in said cap member opposite said first and second aperture means respectively, each of said baffle members comprising end and side walls forming a chamber having an open bottom so as to provide fluid communication between the chambers of said first and second baffle members and said first and second compartments respectively, and a deflector member forming the inner surface of the end wall of the chamber and having a triangular cross-section with the apex of said triangle being directly opposite the associated aperture means, said deflector member being non-apertured such that the flow of condiment therethrough is prevented, whereby when condiment is purposely dispensed from one of said compartments, condiment in the other of said compartments is deflected so that it tends not to be dispensed inadvertently from its associated aperture means.

2. The condiment dispenser of claim 1 wherein said container and said cap are cylindricalin configuration.

3. The condiment dispenser of claim 1 wherein the side walls of the cap member are flush with the side walls of said container.

4. The condiment dispenser of claim 1 wherein the top edge of said container is undercut to form a circular shoulder and the bottom edge of the side wall of said cap member is undercut to form a ring member which matingly engages the shoulder formed in the top edge of the container.

5. The condiment dispenser of claims 1, 3 or 4, wherein said cap member has a rib extending downwardly from the top wall thereof, said rib abutting against the top portion of the divider wall.

6. The condiment dispenser of claim 1 wherein said divider member is in the form of a flat sheet and is positioned to divide the container into two substantially equal compartments.

* * * * *